US006874260B2

(12) United States Patent
Mullett

(10) Patent No.: US 6,874,260 B2
(45) Date of Patent: Apr. 5, 2005

(54) PLOW SYSTEM FOR A VEHICLE

(75) Inventor: Donald Edward Mullett, Zeeland, MI (US)

(73) Assignee: Covenant Resolutions, Inc., Zeeland, MI (US)

( * ) Notice: Subject to any disclaimer, the term of this patent is extended or adjusted under 35 U.S.C. 154(b) by 0 days.

(21) Appl. No.: 10/195,011

(22) Filed: Jul. 12, 2002

(65) Prior Publication Data

US 2004/0006897 A1 Jan. 15, 2004

(51) Int. Cl.[7] ..... E01H 5/04

(52) U.S. Cl. ..... 37/231; 37/410; 37/266; 37/268; 172/747; 172/811; 172/817

(58) Field of Search ..... 172/811, 817, 172/747; 37/410, 266, 268, 264, 231, 235, 232, 233

(56) References Cited

U.S. PATENT DOCUMENTS

| | | | | | |
|---|---|---|---|---|---|
| 1,698,809 | A | * | 1/1929 | Angell | 37/279 |
| 3,800,447 | A | * | 4/1974 | Harvey | 37/236 |
| 4,024,653 | A | * | 5/1977 | Morris | 37/231 |
| 4,119,157 | A | * | 10/1978 | Schuck et al. | 172/477 |
| 4,127,951 | A | * | 12/1978 | Hatch | 37/231 |
| 4,219,947 | A | * | 9/1980 | Paladino | 37/370 |
| 4,310,273 | A | * | 1/1982 | Kirrish | 411/338 |
| 4,403,432 | A | | 9/1983 | Blance | |
| 4,574,502 | A | * | 3/1986 | Blau | 37/266 |
| 4,680,880 | A | * | 7/1987 | Boneta | 37/236 |
| 4,803,790 | A | * | 2/1989 | Ciula | 37/266 |
| 4,833,799 | A | * | 5/1989 | Harte et al. | 37/231 |
| 4,845,866 | A | * | 7/1989 | Ciula | 37/266 |
| 4,907,357 | A | * | 3/1990 | Lilienthal | 37/197 |
| 4,962,598 | A | * | 10/1990 | Woolhiser et al. | 37/231 |
| 4,962,599 | A | * | 10/1990 | Harris | 37/266 |
| 4,976,053 | A | * | 12/1990 | Caley | 37/231 |
| 5,046,271 | A | | 9/1991 | Daniels | |
| 5,048,207 | A | * | 9/1991 | Verseef | 37/281 |
| 5,058,295 | A | | 10/1991 | Holland | |
| 5,088,215 | A | * | 2/1992 | Ciula | 37/197 |
| 5,111,603 | A | * | 5/1992 | Knowlton et al. | 37/231 |
| 5,142,801 | A | * | 9/1992 | Feller | 37/235 |
| 5,177,887 | A | * | 1/1993 | McGugan et al. | 37/236 |
| 5,265,355 | A | * | 11/1993 | Daniels | 37/231 |
| 5,289,880 | A | * | 3/1994 | Barto | 172/799.5 |
| 5,309,653 | A | * | 5/1994 | Pease et al. | 37/266 |
| 5,353,530 | A | * | 10/1994 | Pieper | 37/231 |
| 5,392,538 | A | | 2/1995 | Geerlings et al. | |
| 5,588,232 | A | * | 12/1996 | Renwick | 37/232 |
| 5,603,172 | A | * | 2/1997 | Maher | 37/233 |
| 5,647,153 | A | | 7/1997 | Gervais | |
| 5,655,318 | A | * | 8/1997 | Daniels | 37/231 |
| 5,813,474 | A | | 9/1998 | Manway | |
| 5,860,230 | A | * | 1/1999 | Daniels | 37/232 |
| 5,930,922 | A | | 8/1999 | Altheide | |
| 6,112,438 | A | * | 9/2000 | Weagley | 37/270 |
| 6,134,813 | A | * | 10/2000 | Vickers | 37/196 |
| 6,151,809 | A | | 11/2000 | Altheide | |
| 6,178,669 | B1 | * | 1/2001 | Quenzi et al. | 37/231 |
| 6,277,450 | B1 | * | 8/2001 | Katoot et al. | 427/512 |
| 6,336,281 | B2 | | 1/2002 | Fulton, III | |
| 6,362,727 | B1 | * | 3/2002 | Guy, Jr. | 340/425.5 |
| 6,502,334 | B1 | * | 1/2003 | Davies | 37/231 |

* cited by examiner

*Primary Examiner*—Victor Batson
(74) *Attorney, Agent, or Firm*—King & Jovanovic, PLC

(57) ABSTRACT

The invention comprises a snow plow system capable of attachment to a vehicle. The snow plow system comprises a front snow plow assembly and a rear snow plow assembly. The front snow plow assembly includes a blade, a frame assembly and an attachment system. The attachment system is capable of attaching the blade to the frame assembly. The rear snow plow assembly includes a frame and a blade attached. The frame of the front snow plow assembly and the frame of the rear snow plow assembly comprise an aluminum material having a temper of at least T4.

14 Claims, 11 Drawing Sheets

PLOW SYSTEM FOR A VEHICLE

BACKGROUND OF THE INVENTION

1. Field of the Invention

The invention relates in general to a plow, and more particularly, to a plow system for use in association with a vehicle, such as a pick-up truck, to, in turn, facilitate the removal of, for example, ice, snow and sleet from a roadway.

2. Background Art

Vehicle plows have been known in the art for many years, to, for example, remove snow from an outside surface. While the technology associated with plows has evolved over the years, certain lingering problems have not been resolved, and certain new problems have been presented.

For example, the environment in which snow plows operate is extremely harsh. The blade of the plow is constantly abraded by snow and ice, as well as the underlying gravel or paved surface. Blades are typically made out of a mild steel, which is highly susceptible to rust and abrasive damage. While these blades are typically painted to protect the underlying steel, the paint is quickly abraded and, in turn, the bare steel is exposed to the elements. Destructive corrosion soon follows.

Certain solutions have been attempted, such as the use of composite materials. However, while corrosion is not an issue with such composites, such materials do not respond well to the abrasive environment in which the snow plow operates. Furthermore, the composites tend to be exceedingly expensive and difficult to manufacture. Other materials do not respond well in such a harsh and abrasive environment.

Moreover, snow plows of the type described above are generally quite heavy. Automotive manufacturers, in the interest of safety, cost and weight have generally made pick-up truck frames from thinner steel. As a result, repetitive operation of trucks with heavy snow plows has lead to failures in the frames. In addition, the large weight of the plows has placed an additional toll on brakes, transmissions, engines and suspension, causing premature failure and replacement of same. Furthermore, the heavy plows have an adverse effect on fuel economy and emissions.

As a result, it is an object of the present invention to provide a snow plow system which overcomes the deficiencies of the prior art.

SUMMARY OF THE INVENTION

The invention comprises a snow plow system capable of attachment to a vehicle. The snow plow system comprises a front snow plow assembly and a rear snow plow assembly. The front snow plow assembly includes a blade, a frame assembly and an attachment system. The attachment system is for attaching the blade to the frame assembly. The rear snow plow assembly includes a frame and a blade. The blade is attached to the frame. Each of the frame of the front snow plow assembly and the frame of the rear snow plow assembly comprise an aluminum material having a temper of at least T4.

In a preferred embodiment, the frame assembly of the front snow plow assembly comprises a plurality of channels and at least one rib. The plurality of channels extend between opposing side edges of the blade. The at least one rib extends between a top edge and a bottom edge of the blade.

In one preferred embodiment, the plurality of channels comprises at least three channels extending along a back surface of the frame assembly, wherein the at least three channels are substantially parallel to each other. In another such preferred embodiment, the at least one rib comprises at least two ribs. Each of the at least two ribs is substantially parallel to each other and substantially perpendicular to the at least three channels.

In one embodiment, the attachment system comprises a plurality of fasteners that extend through at least one of the at least one rib and the plurality of channels, to, in turn, releasably retain the blade thereto. In another such embodiment, the attachment system further comprises an insulator positioned between the frame assembly and the blade, to, in turn, substantially preclude any galvanic corrosion therebetween.

Preferably, the rear snow plow assembly further comprises a hitch assembly, the hitch assembly is attachable to a vehicle and is capable of receiving the frame, to, in turn, releasably retain same. In one such embodiment, the hitch assembly further includes a body, at least one frame attachment member and at least one frame receiver member.

In one such embodiment, the at least one frame attachment member comprises a frame attachment member positioned proximate either end of the body. Additionally, the at least one frame receiver member comprises a frame receiver member positioned proximate either end of the body and proximate the frame attachment members. Preferably, each frame attachment member further comprises at least two flanges capable of securing to a different surface of a frame of a vehicle. Likewise, it is preferred that the frame of the rear snow plow assembly further includes at least one guide. The at least one frame receiver member further includes at least one channel. The at least one guide is capable of receipt within the at least one channel, to, in turn, further facilitate releasable engagement of the rear snow plow assembly with the hitch.

In another aspect of the invention, the invention comprises a front snow plow assembly capable of attachment to a vehicle. In such an aspect of the invention, the front snow plow assembly comprises a blade, a frame assembly and an attachment system. The attachment system is capable of attaching the blade to the frame assembly. The frame of the front snow plow assembly comprises an aluminum material having a temper of at least T4.

In one embodiment, the frame assembly further comprises a plurality of channels and at least one rib. The plurality of channels extends between opposing side edges of the blade. The at least one rib extends between a top edge and a bottom edge of the blade.

In another preferred embodiment, the plurality of channels comprises a single integrated member. In one such embodiment, the plurality of channels are substantially parallel to each other. Similarly, the at least one rib extends substantially orthogonal with the plurality of channels.

In another such embodiment, the attachment system further comprises a plurality of fasteners.

In another aspect of the invention, the invention comprises a rear snow plow assembly capable of attachment to a vehicle. The rear snow plow assembly comprises a frame and a blade attached to the frame. The frame of the rear snow plow assembly comprises an aluminum material having a temper of at least T4.

In one embodiment, the frame further comprises a body, at least one upper linkage and at least one lower linkage. The at least one upper linkage is pivotally associated with each of the blade and the body. The at least one lower linkage is pivotally associated with each of the blade and the body. The upper and lower linkages are substantially parallel in orientation, to, in turn, facilitate linear movement of the blade relative to the body.

In another embodiment, the frame further includes a hitch attachment assembly. The hitch attachment assembly includes at least one support and at least one guide positioned on the at least one support. The hitch assembly comprises a body, at least one frame attachment member and a frame receiver member. The frame attachment member is associated with the body. The frame receiver member is associated with at least one of the body and the at least one frame attachment member. The frame receiver member includes at least one guide channel positioned thereon, at least one support region associated therewith and at least one fastening assembly. Upon association of the frame and the hitch, the at least one guide of the frame is capable of receipt into the at least one guide channel, the at least one support region is capable of supporting at least a portion of the frame, and the at least one fastening assembly is capable of interfacing with the at least one fastening assembly of the hitch attachment assembly of the frame, to, in turn, releasably retain same.

In yet another embodiment, the at least one frame attachment member comprises at least two frame attachment members, positioned on opposing ends of the body. Similarly, the at least one frame receiver member comprises at least two frame receiver members, positioned on opposing ends of the body.

BRIEF DESCRIPTION OF THE DRAWINGS

The invention will now be described with references to the drawings wherein.

DETAILED DESCRIPTION OF THE INVENTION

Figure 1:
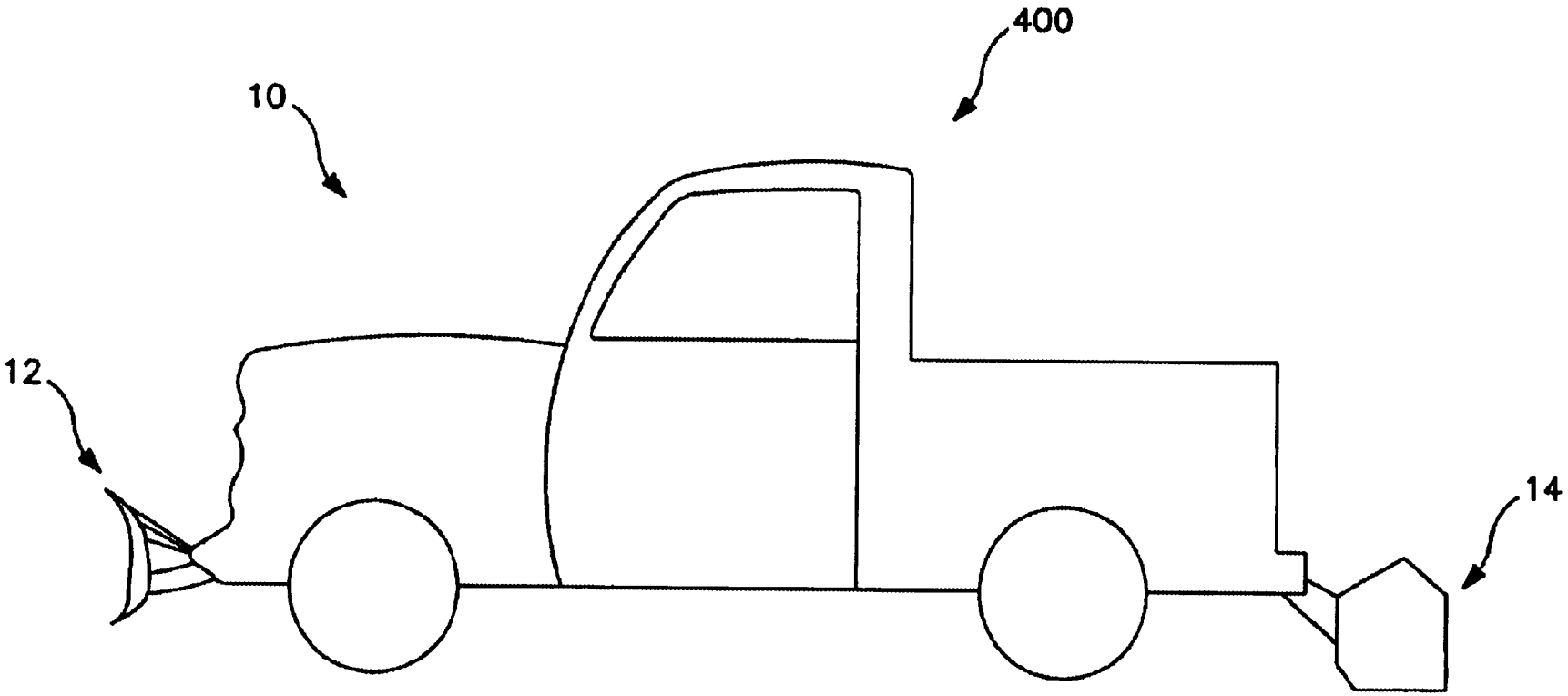
FIG. 1 of the drawings comprises a side elevational view of an embodiment of a plow system in accordance with the present invention, shown, in particular, as being mounted on a vehicle.

While this invention is capable of embodiment in many different forms, there is shown in the drawings and will be described herein in detail, one specific embodiment with the understanding that the present disclosure is to be considered as an exemplification of the principles of the invention and is not intended to limit the invention to the embodiment illustrated.

It will be understood that like or analogous elements and/or components, referred to herein, are identified throughout the drawings by like reference characters. In addition, it will be understood that the drawings are merely representations, and some of the components may have been distorted from actual scale for purposes of pictorial clarity.

Snow plow system 10 is shown in FIG. 1 as comprising front snow plow assembly 12 and rear snow plow assembly 14. The snow plow system is configured for use in association with vehicle 400, such as a quarter ton, half ton and three quarter ton pick-up truck conventionally provided by manufacturers such as Ford, GM/Chevrolet and Dodge. One example may comprise a Ford F-150, 250 or 350. Of course, larger or smaller trucks are contemplated for use, and the invention is not limited for use in association with any particular class or designation of truck. Further, it is contemplated that depending on the application, either of the front or rear snow plow assemblies can be utilized individually.

Figure 2:
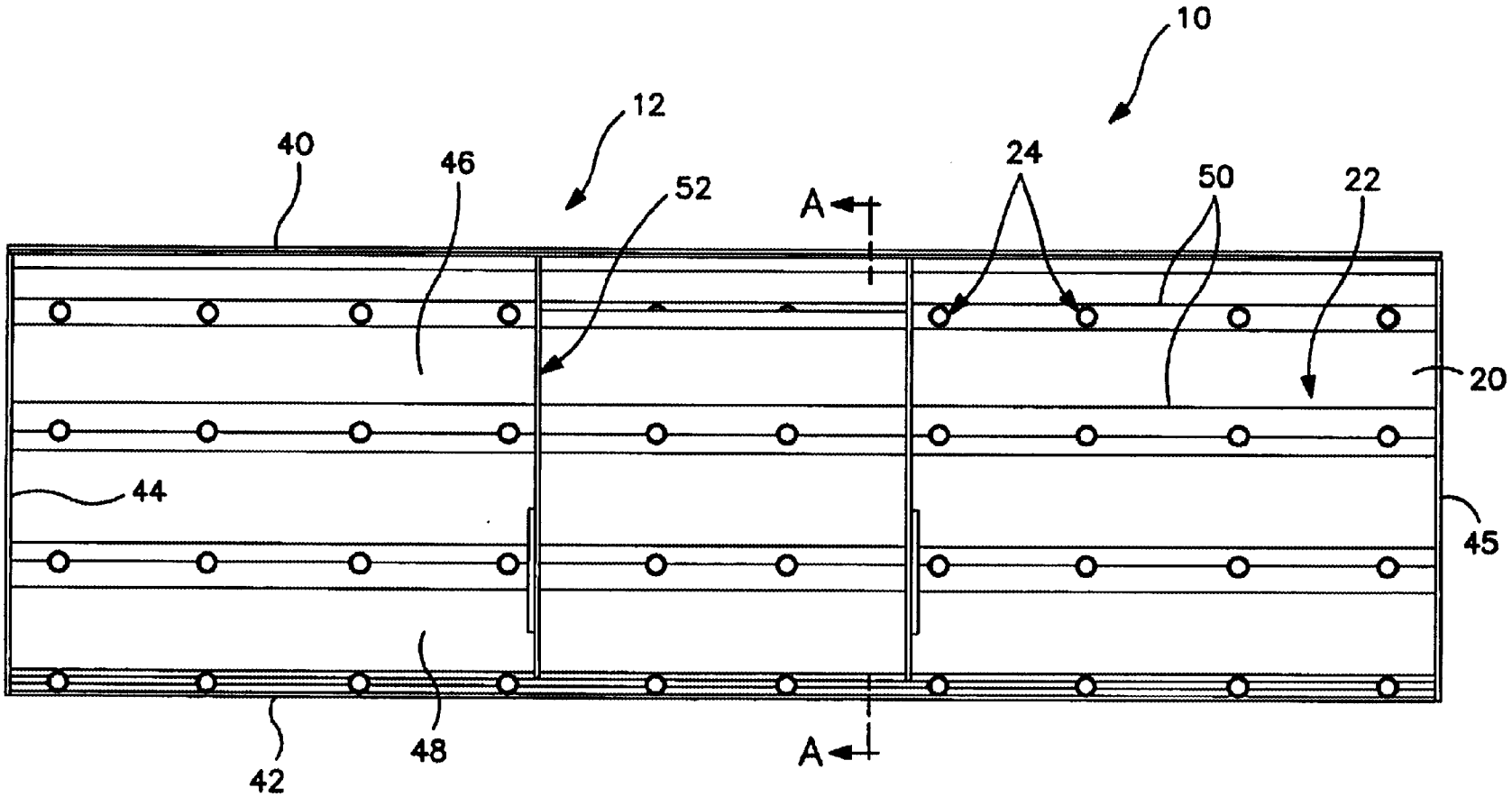
FIG. 2 of the drawings comprises a back elevational view of an embodiment of a front snow plow assembly in accordance with the present invention.

Front snow plow assembly 12 is shown in FIGS. 2 and/or 3 as comprising blade 20, frame assembly 22, attachment system 24, scraper 26 and deflector 28.

Blade 20 includes top edge 40, bottom edge 42, side edges 44, 45, front surface 46 and back surface 48. Front surface 46 is of a generally concave configuration which may be substantially uniform in configuration, or which may be a compound curve. Dimensionally, the blade preferably has a height of about 30 to 35 inches and a width of about 7 to 8.5 feet. Of course, the blade is not limited to such a dimension. Preferably, blade 20 comprises an aluminum sheet material having a suitable thickness, such as 3/16 inches. The aluminum contemplated for use comprises a 3xxx series aluminum which is rather suitable for forming into the desired shape. Additionally, such a structure is of sufficient strength when coupled with the below-described frame structure. Of course, other materials are likewise contemplated for use Such a material has been found to offer sufficient strength for the blade, while providing a vast weight savings over a comparable mild or stainless steel blade. Due to the material of the blade, side edges 44, 45 may be separated further from each other as compared to a conventional blade, such that the resulting blade may be wider, without sacrificing operability and weight considerations. Indeed, even a small truck is capable of operating a wider blade of, preferably, 7 to 8.5 feet in width, which is generally too heavy for such a truck when made from conventional material. Moreover, while the painted protecting surface required on conventional steel blades is worn away during use, thereby allowing corrosion to occur, use of an aluminum blade precludes the use of such a painted protectant. As a result, the working surface of the blade is continuously polished and cleaned by way of abrasion through the material that is pushed by the blade (snow, ice, gravel, etc). Of course, other materials are likewise contemplated for use, including metals, certain composites, as well as polymers (wherein the underlying frame is of sufficient strength).

Figure 3:
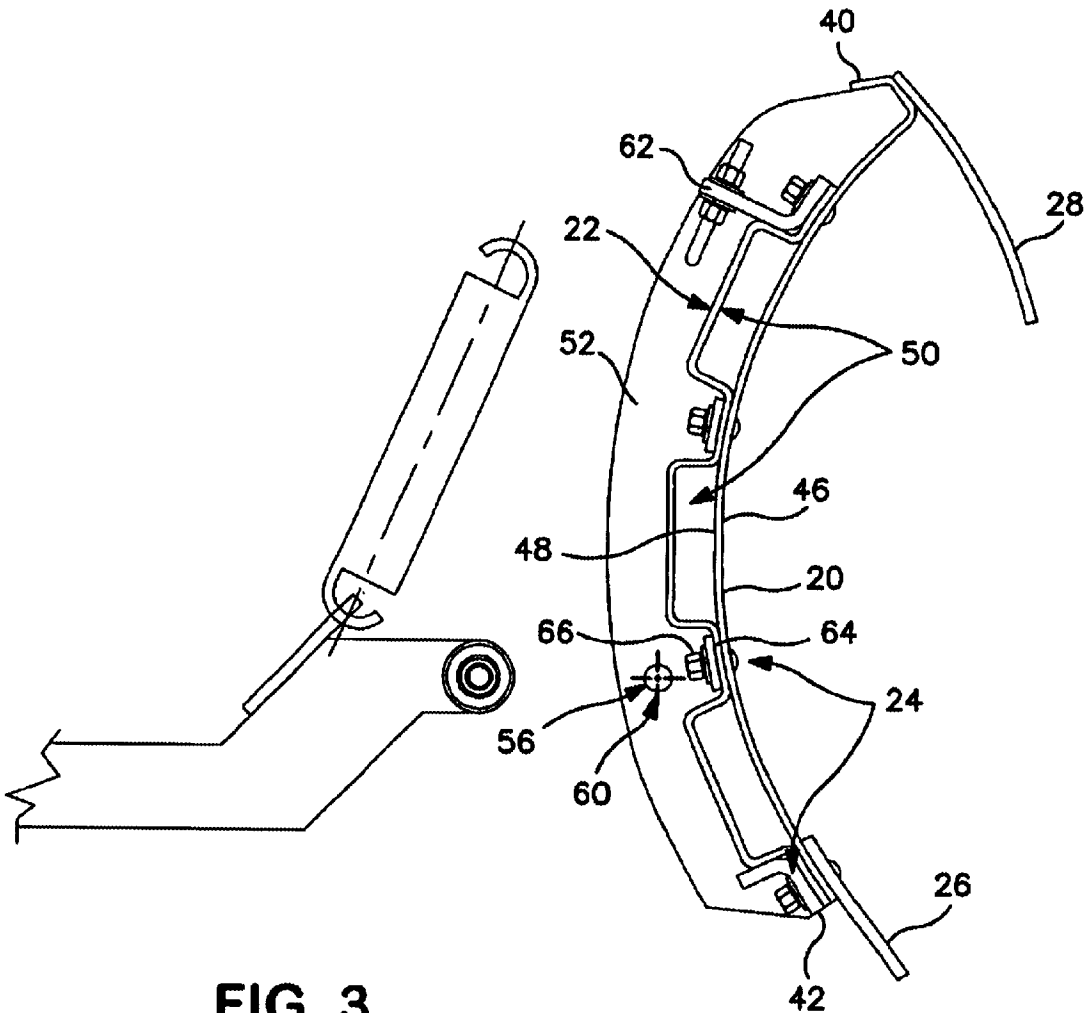
FIG. 3 of the drawings comprises a cross-sectional view of an embodiment of a front snow plow assembly in accordance with the present invention, taken generally about lines A—A of FIG. 2.

Frame assembly 22 is shown in FIGS. 2 and 3 as comprising a plurality of channels, such as channels 50, ribs, such as ribs 52, and attachment member 56.

Figure 4:
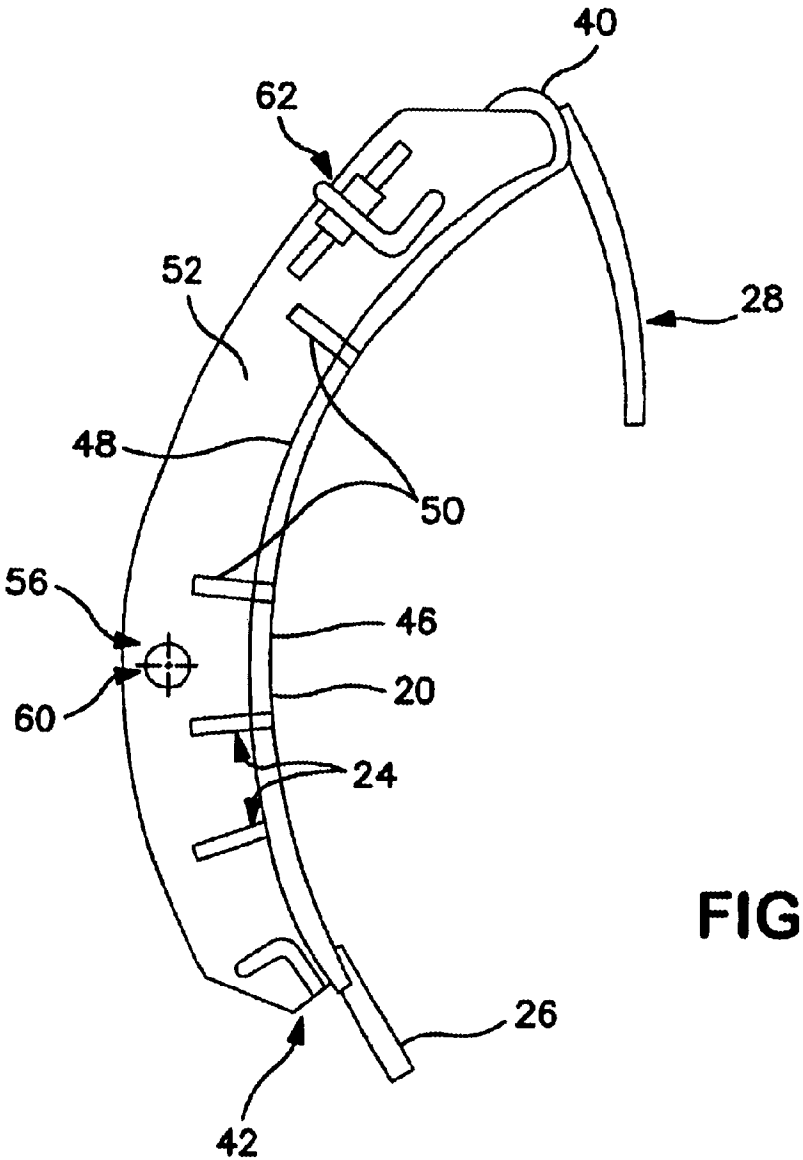
FIG. 4 of the drawings comprises a cross-sectional view of an embodiment of a front snow plow assembly in accordance with the present invention.

Channels 50 extend along back surface 48 between side edge 44 to side edge 45. In the embodiment shown, each of channels 50 extends from side edge 44 to side edge 45 continuously. Additionally, the various channels 50 are substantially parallel to each other along the back surface of the frame assembly. In various embodiments, it is likewise contemplated that the channels may comprise a plurality of discontinuous segments that extend between the side edges. In other embodiments, it is likewise contemplated that the various channels 50 may be oblique relative to each other. The channels may be separate components which interface about the fasteners. In other embodiments, the channels may comprise a single integrated member (such as an extrusion). Preferably, the channels comprise an aluminum sheet material or extrusion which is of sufficient strength. For example, the aluminum contemplated for use comprises a 6xxx aluminum of a T4 or greater temper. Such a material has been found to offer sufficient strength and durability while providing an improved strength to weight ratios. Of course, other materials are contemplated for use. In further embodiments, the channels comprise a plurality of ribs (as shown in FIG. 4) which extend horizontally between the side edges of the blade.

Ribs 52, as shown in FIGS. 2 and 3, extend between bottom edge 42 and top edge 40, along back surface 48. Each rib 52 is configured to interface with at least one of channels 50; for example, in the preferred embodiment, each rib 52 extends orthogonal to channels 50, and is shaped to interface with each of channels 50. In the preferred embodiment, the ribs comprise an aluminum structure which is matingly engaged to the channels. In other embodiments, the ribs may comprise a steel material which is bonded to, yet insulated from the aluminum material of the channels. While two ribs are shown, a greater or fewer number of ribs may be utilized to provide the necessary support to the blade. Interestingly, with the foregoing channels and ribs, in an aluminum material, the structure is of sufficient strength so as to enable the use of a composite or a polymer blade. Indeed, the structural integrity of same can be maintained by the underlying frame structure.

Figure 6:
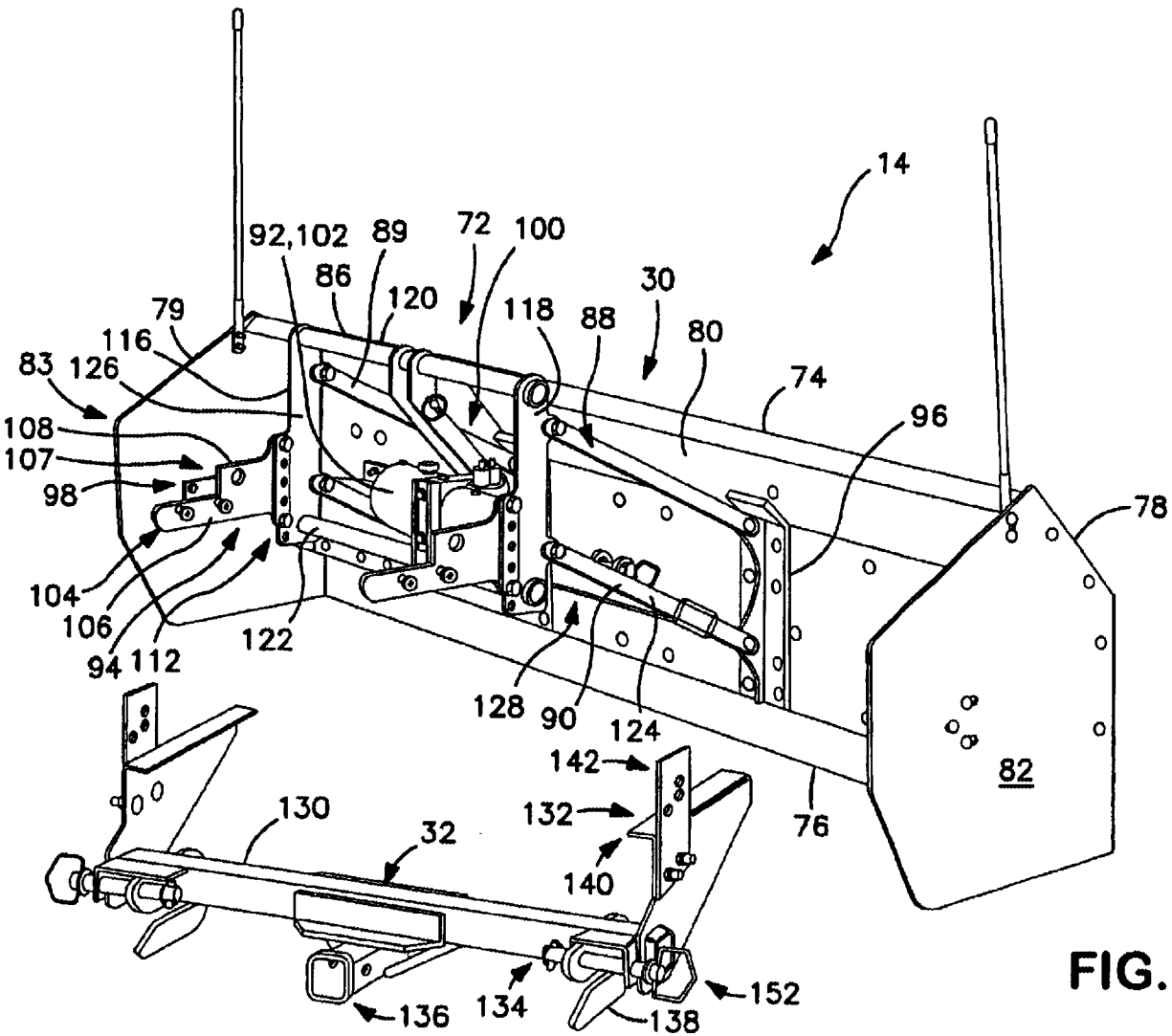
FIG. 6 of the drawings comprises a front, top, side exploded perspective view of an embodiment of a rear snow plow assembly in accordance with the present invention.

Attachment member 56 is shown in FIG. 6 as comprising a structure associable with each of channels 50 and ribs 52. The attachment member facilitates attachment of an "A" frame with the blade. In particular, attachment member 56 includes pivot assembly 60 and hook assembly 62. Pivot assembly 60 is associated with rib 52 and facilitates the placement of a pin through a portion of the "A" frame and rib 52 to releasably retain same. Hook assembly 62 is associated with channel 50 and facilitates the attachment of a biasing member. It is contemplated that an embodiment may include a plurality of pivot assemblies associated with a plurality of ribs. Additionally, a plurality of hook assemblies positioned at various regions relative to channels 50 are contemplated for use. In addition, other assemblies for attachment of front snow plow assembly 12 to the "A" frame are contemplated for use.

Attachment system 24 is shown in FIG. 3 as comprising insulator 64 and fasteners 66.

Insulator 64 is positioned between frame assembly 22 and blade 20 so as to preclude the contact therebetween, to, in turn, preclude a galvanic reaction (corrosion) between the aluminum (or aluminum alloy) of the blade and the steel of the frame. Insulator 64 may comprise a variety of materials, such as, rubber, plastic, composites, or coatings that may be dipped, brushed or sprayed. In embodiments wherein the frame and the blade do not comprise materials which have an undesirable galvanic reaction, an insulator can be eliminated.

Fasteners 66 comprise a plurality of nuts and screws which extend through the blade and at least one of channels 50 and ribs 52. The fasteners attach the blade to the channels and the ribs. It is contemplated that the fasteners can be made of a material which is suitable to preclude or to minimize any galvanic reaction between the various components.

It is contemplated, in other embodiments, that the frame member may comprise an aluminum (or aluminum alloy) material. In such an embodiment, the frame member and, in particular, the channels and the ribs can be welded to the blade. Of course, due to the ruggedness of the material it may be necessary to re-heat treat the welded areas to achieve at least a T4 temper. In other embodiments, the various components may be adhered to each other with certain of the newly developed high strength adhesives, such as those commercially available from Lord Adhesives.

Scraper 26 is shown in FIG. 3 as comprising a strip of material positioned proximate bottom edge 42 of blade 20 extending between side edges 44, 45. Scraper 26 may comprise a variety of materials which are well suited to provide a function of scraping ice and snow that is contacting the ground. Scraper 26 may comprise a metal, composite or a plastic/rubber material, depending on the environment of use.

Deflector 28 is shown in FIG. 3 as comprising a strip of material positioned proximate top edge 40 of blade 20 extending between side edges 44, 45. Deflector 28 directs the material pushed by blade 20 so as to remain within the confines of the blade, and to preclude the passage of material over top edge 40 of the blade. Preferably, deflector 28 comprises a rubber or other flexible material which can provide sufficient resiliency to redirect the material, but which can cushion and absorb some of the energy imparted to the material.

Figure 5:
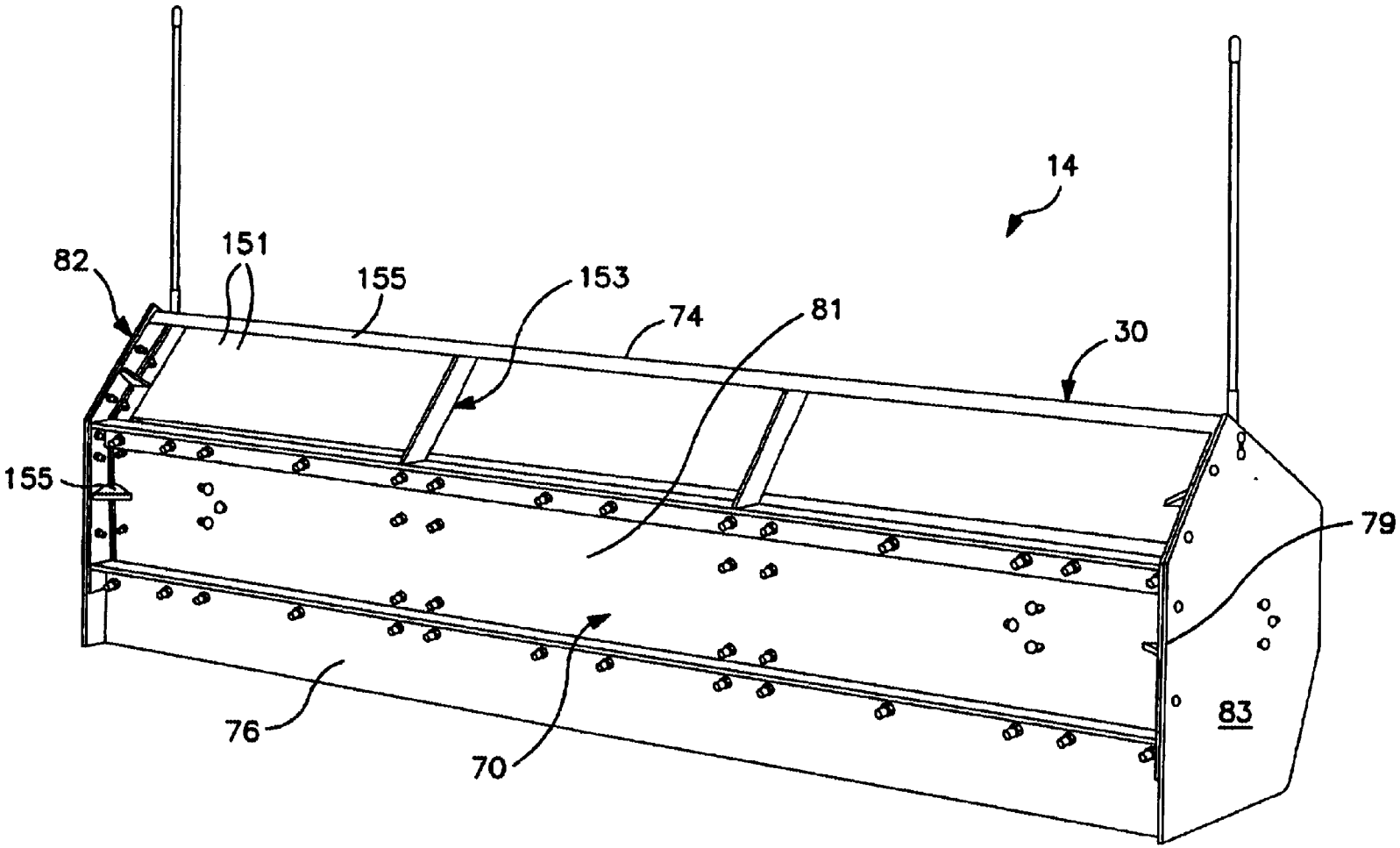
FIG. 5 of the drawings comprises a back, top, side perspective view of an embodiment of a rear snow plow in accordance with the present invention.

Rear snow plow assembly 14 is shown in FIGS. 5 and/or 6 as comprising rear snow plow 30 and hitch assembly 32. Rear snow plow 30 includes blade 70 and frame 72.

Blade 70 includes top edge 74, bottom edge 76, side edges 78, 79, front surface 80, back surface 81, opposing side caps 82, 83 and brackets 84. Front surface 80 of blade 70 is substantially concave in shape. In the embodiment shown, the blade includes two segments, a first segment which is substantially orthogonal with the surface which is to be cleaned, and a second segment which extends at an angle therefrom to form the concave surface. As shown with particular reference to FIG. 5, back surface 81 of blade 70 includes a plurality of channels to increase the strength thereof. For example, certain channels, such as channel 151, extend between respective side edges 78, 79, whereas other channels, such as channel 153 and 155, extend between other boundaries to provide support for other channels.

Opposing side caps 82, 83 are positioned at opposing side edges 78, 79, respectively, and are substantially orthogonal to blade 70 so as to define a cavity therewith. The opposing side caps may be attached to the blade through a variety of means, including, but not limited to, welding, adhering and attaching with fasteners. A scraper, having properties similar to those of scraper 26 may be positioned along bottom edge 76 of blade 70. Similarly, a deflector, having properties similar to those of deflector 28 may be positioned along top edge 74 of blade 70. Generally the rear blade may have a height of between 16 and 26 inches and a width of between 7 and. 8.5 feet. Of course, other dimensions, depending on the application, are contemplated for use.

Each of blade 70 and end caps 82, 83 generally comprise an aluminum material having at least a T4, and more preferably a T6, temper. Such a material has great advantages relative to durability and appearance, while having the strength necessary to maintain integrity in an environment which necessitates a snow plow system of the present invention. Specifically, the material remains substantially free of corrosion and the appearance should not deteriorate even after a number of years of use. Indeed, the working surface of the blade is polished by the abrasion of the snow or other material pushed thereby. However, unlike other blades, the blade appearance does not significantly deteriorate after periods of non-use.

Brackets 84 are shown in FIGS. 6 and/or 7 as comprising blade attachment bracket 96 and end cap retaining brackets 98.

Blade attachment bracket 96 facilitates attachment of the blade to the frame. Blade attachment bracket 96 generally comprises a metal material, which may be welded or fastened to blade 70. In the event that the bracket and the blade comprise incompatible materials, then an insulator, such as is described above relative to the front snow plow, may be utilized to preclude contact between the dissimilar materials, and, in turn, an undesired galvanic reaction therebetween.

End cap retaining brackets 96 support side caps 82, 83 so that they remain properly oriented relative to blade 70. In the embodiment shown, each of the end cap retaining brackets comprise a member which is fastened (or otherwise attached, i.e., welded) to each of the respective end cap and the respective bracket. Again, where dissimilar materials are utilized, an insulator of the type described above may be utilized to preclude a galvanic reaction therebetween.

Figure 7:
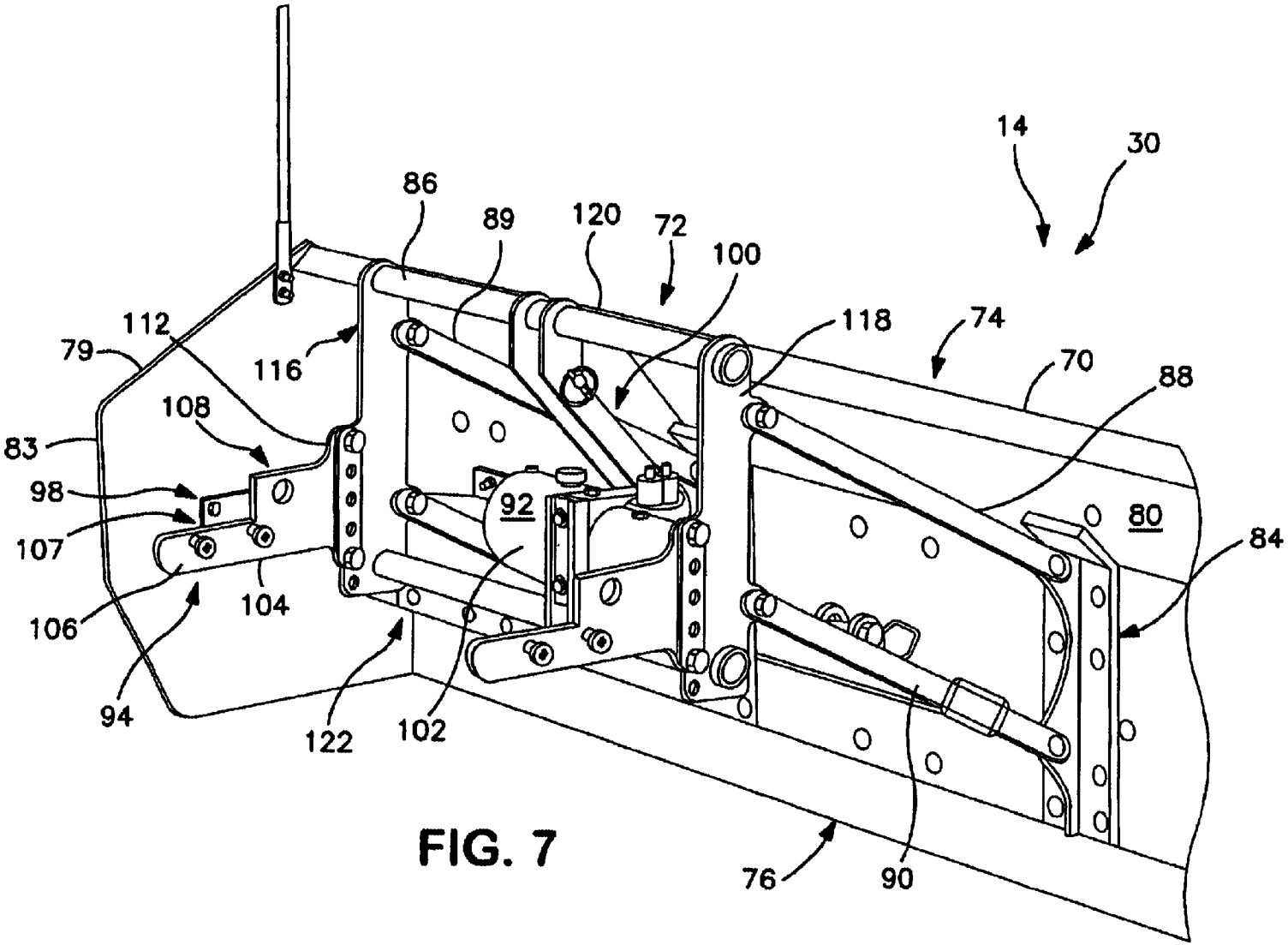
FIG. 7 of the drawings comprises a partial front, top, side perspective view of an embodiment of a rear snow plow, showing, in particular, a frame thereof in accordance with the present invention.
Figure 8:
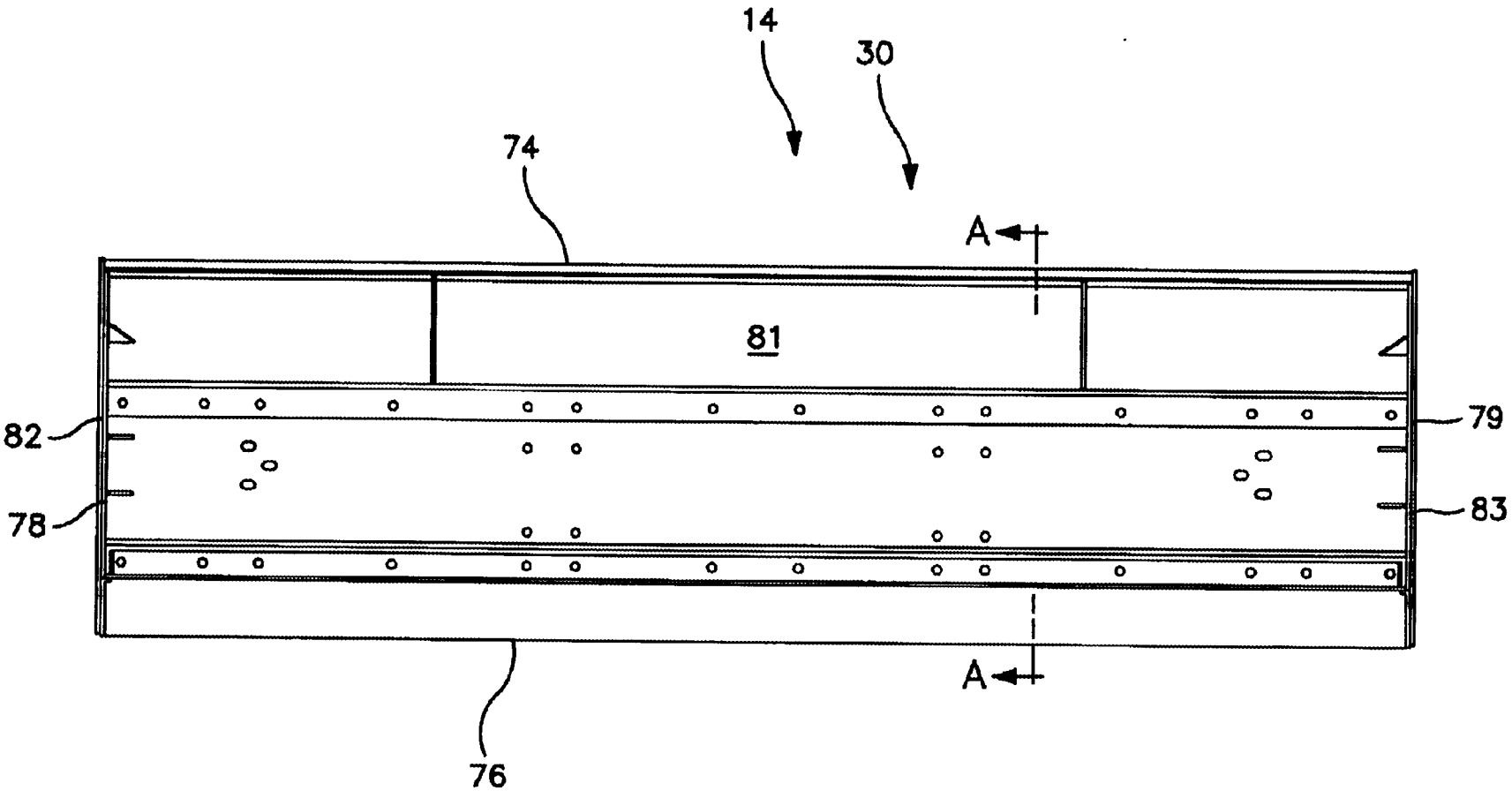
FIG. 8 of the drawings comprises a back elevational view of a rear snow plow assembly in accordance with the present invention.
Figure 9:
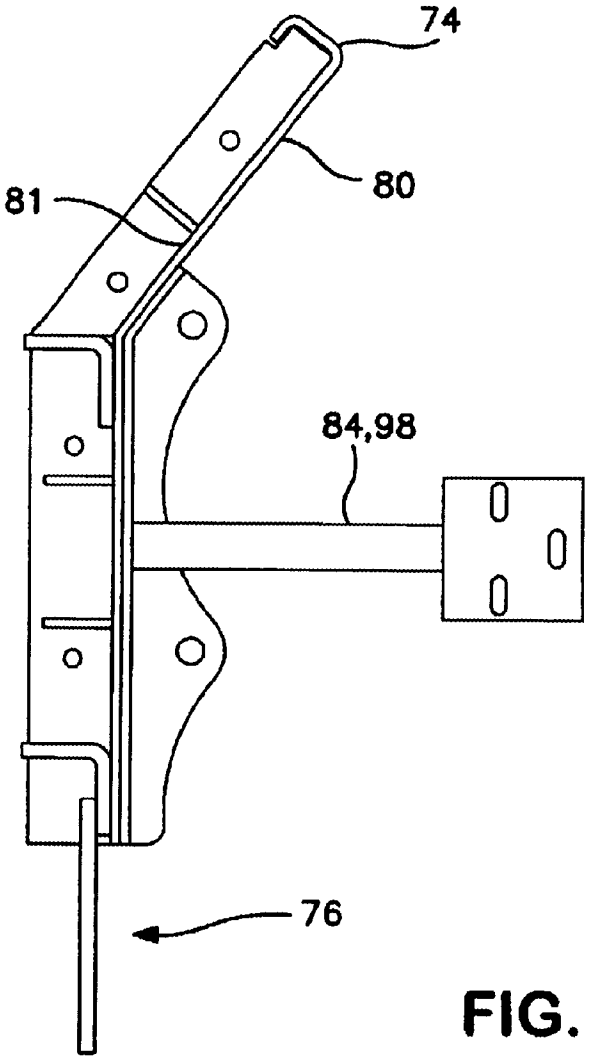
FIG. 9 of the drawings comprises a cross-sectional view of a rear snow plow assembly in accordance with the present invention, taken generally about lines A—A of FIG. 8.
Figure 10:
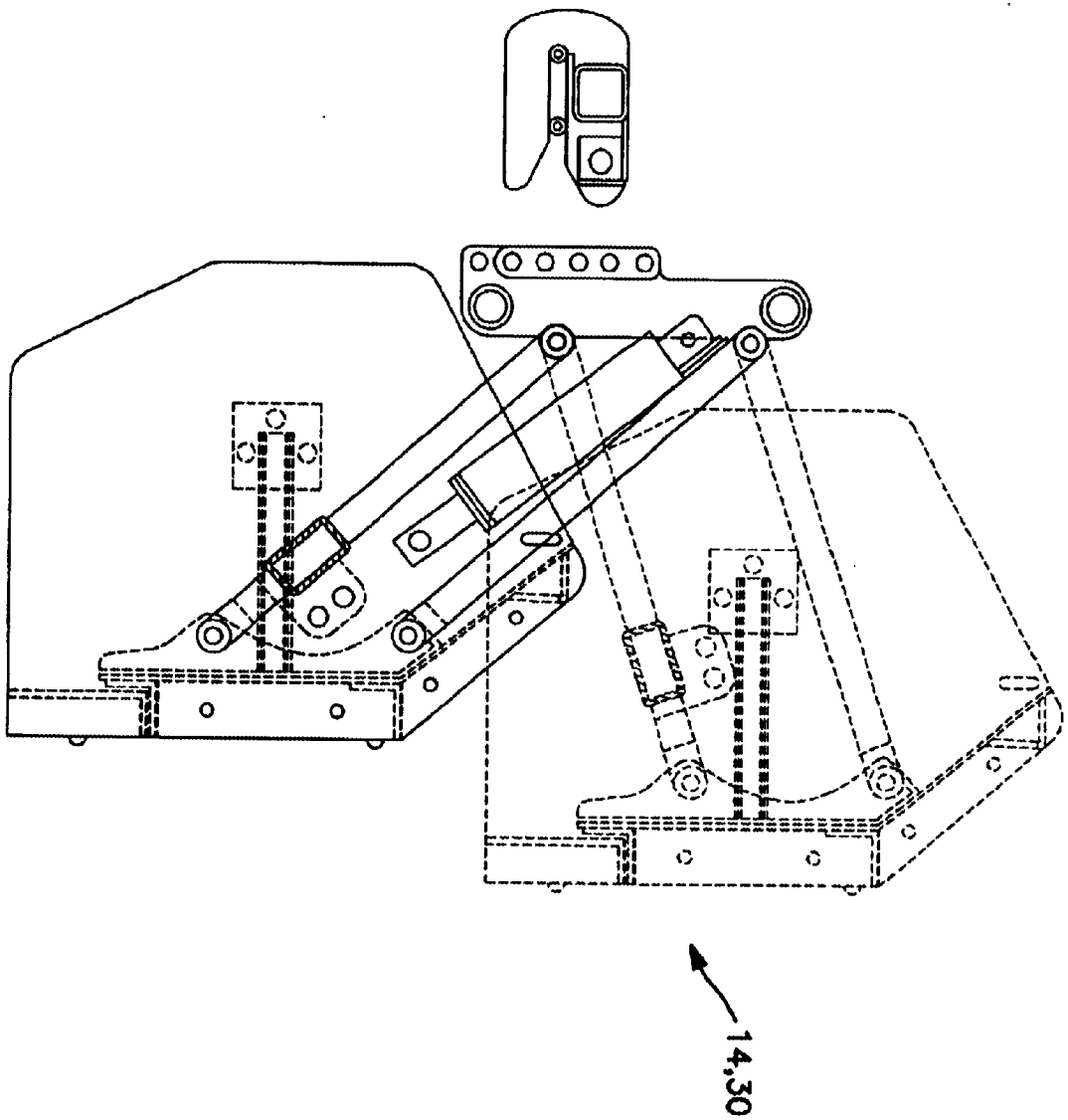
FIG. 10 of the drawings comprises a side elevational view of a rear snow plow assembly in accordance with the present invention, showing, in particular, the vertical movement of a rear snow plow blade.

Frame 72 is shown in FIGS. 6, 7, 10 and/or 11 as comprising body 86, upper linkages 88, 89, lower linkage 90, hydraulic system 92 and hitch attachment assembly 94.

Body 86 generally comprises side panels 116, 118, top panel 120 and bottom panel 122. Side panels 116, 118 generally comprise a substantially flat steel member having a desired dimension. Top panel 120 and bottom panel 122 generally comprise a tubular material extending between the side panels. Generally the side panels are welded to the top and bottom panels. In turn, the frame provides a rigid and substantial member to which the blade and the hitch can be interfaced.

Figure 11:
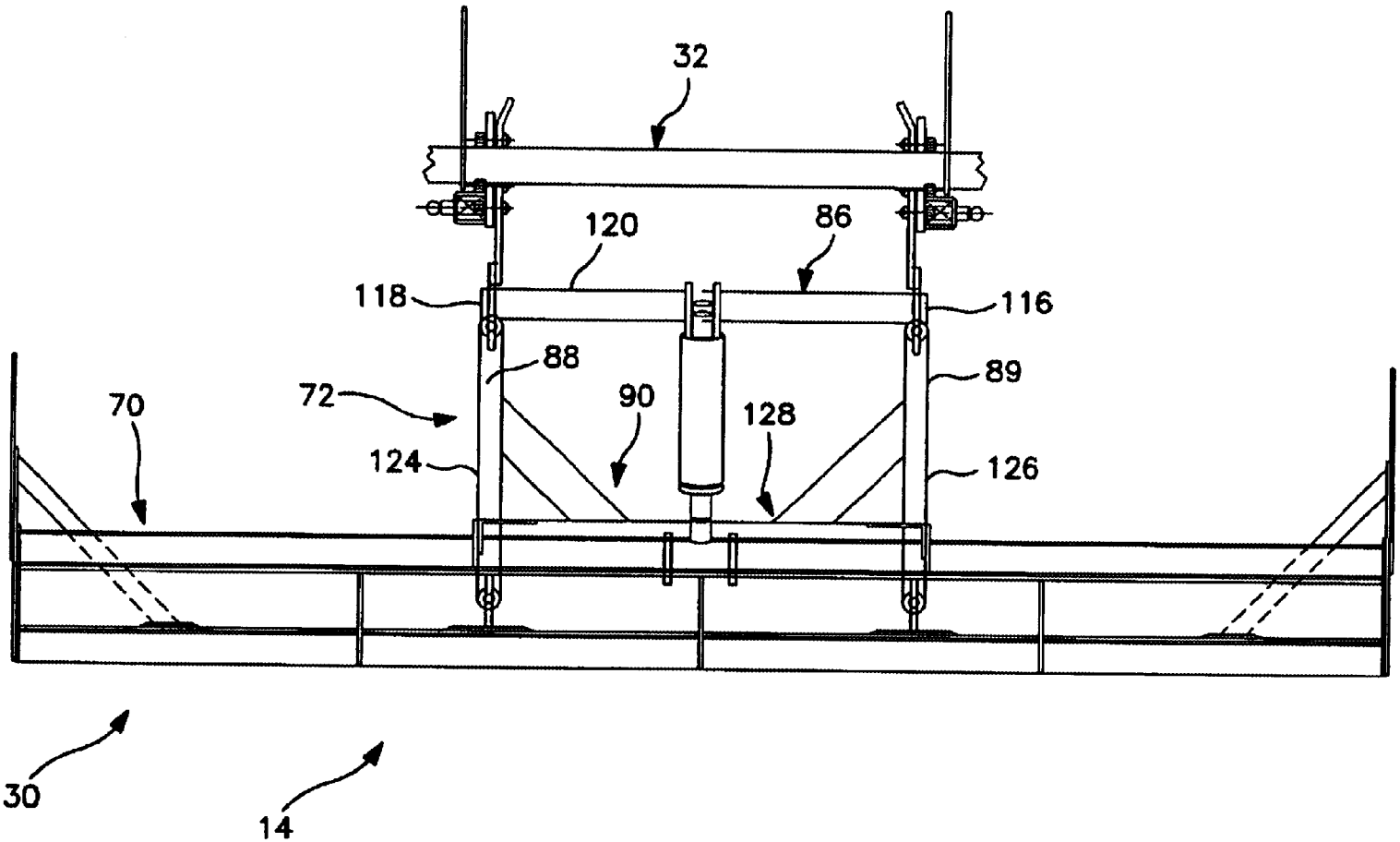
FIG. 11 of the drawings comprises a top plan view of a rear snow plow in accordance with the present invention.

Upper linkages 88, 89 are pivotally associated with a respective blade attachment bracket 96 and with a respective side panel 116, 118 of frame 86. Lower linkage 90 includes side members 124 and 126, which substantially correspond to upper linkages 88 and 89, and support member 128. Indeed, in a preferred embodiment, the side members 124, 126 are substantially identical in length and orientation (i.e. parallel) to respective linkages 88, 89, to, in turn, substantially form a parallelogram. Support member 128 attaches to each of side members 124, 126, and provides additional support for the linkages, as well as a support to which the hydraulic system can be attached. As shown in FIG. 11, the pivoting of the linkages and, in turn, the blade is substantially vertical, precluding arcuate travel of the blade as would be traveled with use of a single linkage.

Referring again to FIGS. 6 and 7, hydraulic system 92 comprises hydraulic cylinder 100 and motor 102. To achieve same, motor 102 is attached to bottom panel 122 of body 86. Hydraulic cylinder 100 is pivotally associated with each of top panel 120 of body 86 and support member 128 of lower linkage 90. Motor 102 is capable of controlling the expansion and contraction of hydraulic cylinder 100.

Hitch attachment assembly 94 is shown in FIGS. 6 and 7 as comprising support members 104, guides 106 and fastening assembly 108. Each support member 104 includes hitch body engaging region 107 and further comprises a panel upon which guides 106 and fastening assembly 108 can be positioned. Each support member is releasably attachable to a respective side panel 116, 118 of body 86 via an adjustment assembly. In particular, the support member includes a plurality of openings which can selectively be placed in communication with corresponding openings on side panels 116, 118 of body 86. In turn, by varying the cooperation of the different openings of the respective members, the position of the frame can be varied relative to the position of the hitch and, in turn, the vehicle. As such, a variety of different trucks having different suspension configurations and tire configurations can be accommodated with a single device.

Guides 106 comprise a plurality of pins associated with support members 104. The pins are slidably engageable into a corresponding slot of the hitch, to, in turn, facilitate the proper positioning of the frame relative to the hitch.

Fastening assembly 108 comprises an opening and a pin associated with each of support members 104. The opening corresponds to an opening on the hitch and the pin can be positioned to extend through both the hitch and the support member, to maintain same in releasable engagement.

Hitch assembly 32 is shown in FIGS. 6, 10 and/or 11 as comprising body 130, frame attachment member 132, frame receiver 134 and hitch 136.

Body 130 generally comprises a tubular member having a substantially square cross-sectional configuration. The length of the body substantially corresponds to the width of the frame of the vehicle to which the hitch is to be attached. Preferably, the entire hitch assembly comprises a steel material which is capable of supporting the rear plow and which is capable of simultaneously replacing a conventional hitch.

The particular embodiment shown includes two frame attachment members 132 which are positioned on opposing sides of body 130, proximate the respective ends thereof. Each frame attachment member 132 comprises lower flange 140 and side flange 142.

Lower flange 140 includes a plurality of openings which may correspond to openings on the vehicle frame. In turn, securement of same is achieved by the placement of fasteners through each of the openings of lower flange 140 and the vehicle frame.

Side flange 142 is substantially orthogonal to lower flange 140. As with lower flange 140, the side flange includes a plurality of openings which may correspond to openings in the side of the frame of the vehicle. Fasteners are then attached through the openings of each of the side of the frame and the side flange to further secure the frame and the hitch. The attachment of the hitch to each of the bottom and the side of the frame (i.e. two different surfaces of the plane) provides a substantially stronger attachment structure which is better suited to retaining the hitch in the desired orientation even after extended use in association with the rear snow plow.

As is shown in FIGS. 6, 10 and/or 11, in one embodiment, two frame receivers 134 are positioned at opposing ends of the frame body. Each frame receiver 134 is shown as including guide channel 138 and fastening assembly 152. Guide channel 138 comprises a channel which is positioned to releasably and slidably receive guides 106 of hitch attachment assembly 94 of frame 72. The outer ends of channel 138 are tapered away from the opening at an angle which facilitates the directing of guides 106 into the guide channel in the event that the guides are initially slightly misaligned with the guide channel.

In position, hitch body engaging region 107 of the support members abuts and, in turn, engages both a bottom horizontal surface and a vertical surface of the hitch body 130, to, in turn, further add stability to the assembly. By contacting and interfacing with two sides of the hitch body, the structure substantially precludes relative movement therebetween.

Fastening assembly 152 is shown as comprising a pair of openings in support region 150 which are substantially collinear. The openings are positioned such that they correspond to the openings of fastening assembly 108 of support 104. In turn, once support member 104 is properly positioned relative to the hitch, a pin is driven through the respective openings of the support member and the support region to, in turn, releasably retain same.

Hitch 136 is shown in FIG. 6 as comprising a conventional hitch member which facilitates the releasable receipt of a variety of components, such as, for example, a trailer, a camper, a bicycle rack, a boat trailer, etc. As such, the hitch assembly can be used as a replacement for a conventional hitch when a rear snow plow is not attached thereto.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A snow plow system capable of attachment to a vehicle, the snow plow system comprising:

a front snow plow assembly including:

a blade having opposing side edges, a top edge and a bottom edge;

a frame assembly, wherein the frame assembly further comprises:

a plurality of channels extending between opposing side edges of the blade, and a pair of ribs extending between a top edge and a bottom edge, the plurality of channels comprising an integrated member comprising an extrusion defining an alternating substantially wave-like configuration, which is attached upon the back surface of the blade, the pair of ribs being attached substantially continuously along a back side of the plurality of channels; and an attachment system for attaching the blade to the frame assembly, wherein the attachment system is configured so that a portion of the wave-like configuration maintains substantial abutment with the blade between opposing side edges, wherein the frame of the front snow plow assembly comprises an aluminum material having a temper of at least T4; and a rear snow plow assembly including:

a frame;

a blade attached to the frame, wherein the frame further comprises:

a body;

at least one non-adjustable upper linkage pivotally associated with each of the blade and the body;

at least one non-adjustable lower linkage pivotally associated with each of the blade and the body, the upper and lower linkages pivotably movable in a continuously substantially parallel orientation, to, in turn, facilitate linear movement of the blade relative to the body, and to maintain the blade at a predetermined angle throughout the operational range of movement thereof; and—wherein each of the frame of the front snow plow assembly and the frame of the rear snow plow assembly comprise an aluminum material having a temper of at least T4.

2. The snow plow system of claim 1, wherein the plurality of channels comprises at least three channels extending along a back surface of the frame assembly, wherein the at least three channels are substantially parallel to each other.

3. The snow plow system of claim 2, wherein the pair of ribs are substantially parallel to each other and substantially perpendicular to the at least three channels.

4. The snow plow system of claim 1, wherein the attachment system comprises a plurality of fasteners that extend through at least one of the pair of ribs and the plurality of channels, to, in turn, releasably retain the blade thereto.

5. The snow plow system of claim 4, wherein the attachment system further comprises an insulator positioned between the frame assembly and the blade, to, in turn, substantially preclude any galvanic corrosion therebetween.

6. The snow plow system of claim 1, wherein the rear snow plow assembly further comprises:

a hitch assembly, the hitch assembly attachable to a vehicle, and capable of receiving the frame, to, in turn, releasably retain same.

7. The snow plow system of claim 6, wherein the hitch assembly further includes:

a body;

at least one frame attachment member; and at least one frame receiver member.

8. The snow plow system of claim 7, wherein:

the at least one frame attachment member comprises a frame attachment member positioned proximate either end of the body; and the at least one frame receiver member comprises a frame receiver member positioned proximate either end of the body and proximate the frame attachment members.

9. The snow plow system of claim 8, wherein each frame attachment member further comprises at least two flanges capable of securing to a different surface of a frame of a vehicle.

10. The snow plow system of claim 8, wherein:

the frame of the rear snow plow assembly further includes at least one guide; and the at least one frame receiver member further includes at least one channel, wherein the at least one guide is capable of receipt within the at least one channel, to, in turn, further facilitate releasable engagement of the rear snow plow assembly with the hitch assembly.

11. A front snow plow assembly capable of attachment to a vehicle, the front snow plow assembly comprising:

a blade having opposing side edges, a top edge and a bottom edge;

a frame assembly, wherein the frame assembly further comprises:

a plurality of channels extending between opposing side edges of the blade, and a pair of ribs extending between a top edge and a bottom edge, the plurality of channels comprising an integrated member comprising an extrusion defining an alternating substantially wave-like configuration, which is attached upon the back surface of the blade, the pair of ribs being attached substantially continuously along a back side of the plurality of channels; and an attachment system for attaching the blade to the frame assembly, wherein the attachment system is configured so that a portion of the wave-like configuration maintains substantial abutment with the blade between opposing side edges, wherein the frame of the front snow plow assembly comprises an aluminum material having a temper of at least T4.

12. The front snow plow assembly of claim 11, wherein the attachment system further comprises a plurality of fasteners.

13. The snow plow assembly of claim 11, wherein the pair of ribs substantially follow the contours of the blade.

14. A snow plow system capable of attachment to a vehicle, the snow plow system comprising:

a front snow plow assembly including:

a blade having opposing side edges, a top edge and a bottom edge;

a frame assembly, wherein the frame assembly further comprises:

a plurality of channels extending between opposing side edges of the blade, and a pair of ribs extending between a top edge and a bottom edge, the plurality of channels comprising an integrated member comprising an extrusion defining an alternating substantially wave-like configuration, which is attached upon the back surface of the blade, the pair of ribs being attached substantially continuously along a back side of the plurality of channels; and an attachment system for attaching the blade to the frame assembly, wherein the attachment system is configured so that a portion of the wave-like configuration maintains substantial abutment with the blade between opposing side edges, wherein the frame of the front snow plow assembly comprises an aluminum material having a temper of at least T4; and a rear snow plow assembly including:

a frame;

a blade attached to the frame, wherein the frame further comprises:

a body;

at least one non-adjustable upper linkage pivotally associated with each of the blade and the body; and at least one non-adjustable lower linkage pivotally associated with each of the blade and the body, the upper and lower linkages pivotably movable in a continuously substantially parallel orientation, to, in turn, facilitate linear movement of the blade relative to the body, and to maintain the blade at a predetermined angle throughout the operational range of movement thereof.

* * * * *